United States Patent [19]

Fischer

[11] 4,136,482

[45] Jan. 30, 1979

[54] MATING PLATE AND AXLE ELEMENT, WITH UNDERCUT CONNECTOR

[76] Inventor: Artur Fischer, Weinhalde 34, D-7244 Waldachtal 3 (Tumlingen), Fed. Rep. of Germany

[21] Appl. No.: 839,589

[22] Filed: Oct. 5, 1977

[30] Foreign Application Priority Data

Oct. 6, 1976 [DE] Fed. Rep. of Germany ... 7631177[U]

[51] Int. Cl.[2] ..... A63H 33/08

[52] U.S. Cl. ..... 46/23

[58] Field of Search ..... 46/16, 17, 23, 26, 31, 46/221

[56] References Cited

U.S. PATENT DOCUMENTS

| | | | |
|---|---|---|---|
| 3,452,452 | 7/1969 | Dore | 46/23 X |
| 3,486,268 | 12/1969 | Fischer | 46/16 |
| 3,553,883 | 1/1971 | Fischer | 46/16 |

*Primary Examiner*—F. Barry Shay

*Attorney, Agent, or Firm*—Michael J. Striker

[57] ABSTRACT

An assembly kit has a plate element having an undercut groove which extends from one edge of the plate element and is open at one face of the latter, and a bore communicating with the undercut groove. The assembly kit also includes an axle element having a pin-shaped portion insertable in the bore of the plate element, a holding portion insertable in the undercut groove of the plate element, and a shaft portion. The holding portion of the axle element has a non-circular cross-section mating with the cross-section of the undercut groove of the plate element and is provided with projecting connecting means for connecting the holding portion with another structural element of the kit. The above connecting means may be formed as an undercut projection extending outwardly beyond the one face of the plate element when the axle element is inserted in the latter. A plurality of such undercut grooves and bores may be provided in the plate element. Two such projections may be formed on the holding portion, each projecting outwardly beyond a respective one of the faces of the plate element.

16 Claims, 1 Drawing Figure

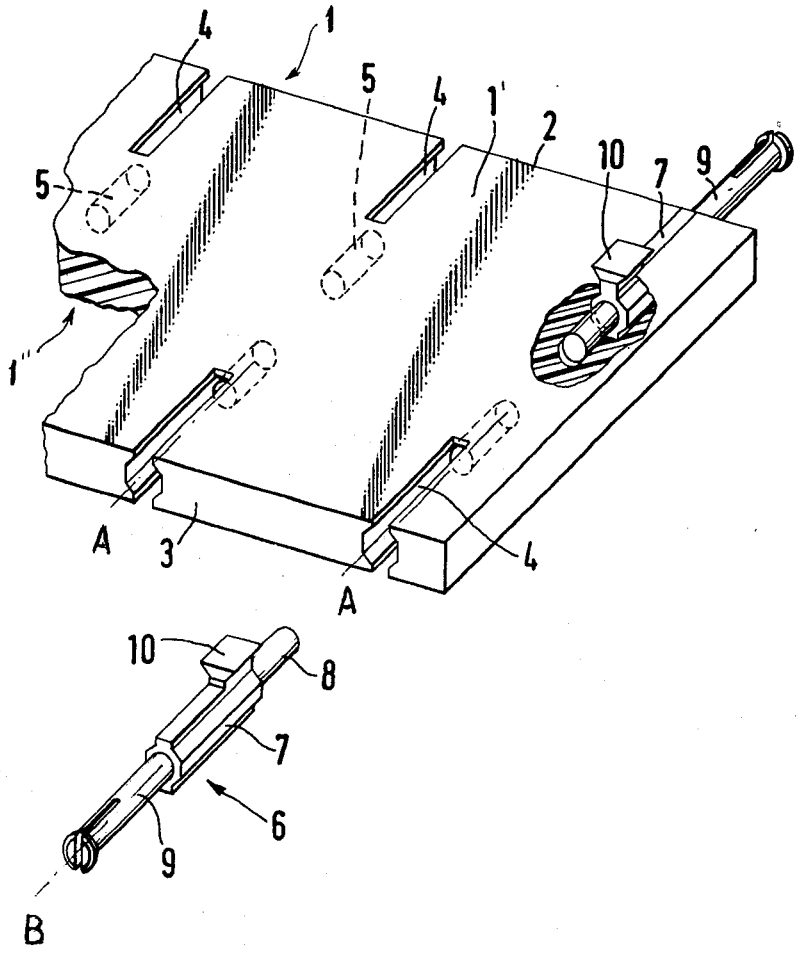
4
1
5
4
1'
2
10
7
9
5
1''
A
3
A
4
10
8
7
6
9
B

MATING PLATE AND AXLE ELEMENT, WITH UNDERCUT CONNECTOR

BACKGROUND OF THE INVENTION

The present invention relates to an assembly kit including structural elements which are connectable with one another by interengaging undercut grooves and projections. More particularly, it relates to an assembly kit including a plate element and an axle element connectable with one another.

A plate element has been proposed in the art, having undercut grooves which are adapted to receive undercut projections of other structural elements so as to connect the latter with this plate element. When such several structural elements are connected with one another, there is possibility for insertion of an axle in the plate elements so as to assemble a vehicle structure. It has also been proposed to provide bores in the above plate elements, each of which bores forms an extension of a respective one of the undercut grooves, in order to increase a region of insertion. The axles are inserted into the above bores of the plate element.

The above known construction possesses some disadvantages. The positioning of the axle as described above is not suitable for an axle adapted to support wheels of the vehicle structure, inasmuch as the necessary stability thereof is not provided in the region of the undercut groove. Furthermore, at the place where the axle is inserted in the plate element there is no possibility to mount a further structural element on the plate element.

SUMMARY OF THE INVENTION

Accordingly, it is an object of the present invention to provide an assembly kit which avoids the disadvantages of the prior art.

More particularly, it is an object of the present invention to provide an assembly kit including a plate element and an axle element connected therewith, in which kit stability of the axle element in connected condition is increased as compared with the known assembly kits.

Another object of the present invention is to provide an assembly kit including a plate element and an axle element connectable therewith, in which when the above elements are connected with one another there is a possibility to mount another structural element of the assembly kit in the region when the axle element is located.

In keeping with these objects, and with others which will become apparent hereinafter, one feature of the present invention resides, briefly stated, in an assembly kit including a plate element having an undercut groove and a bore communicating with the groove, and an axle element connectable with the plate element, in which kit the axle element has a pin-shaped portion insertable into the bore of the plate element, and a holding portion insertable into the undercut groove of the plate element and having a non-circular cross-section mating with the cross-section of the undercut groove. At the same time the holding portion of the axle element is provided with projecting connecting means for connecting the same with another structural element of the assembly kit.

In the thus-constructed assembly kit a pin-shaped portion of the axle element is first inserted into the bore of the plate element, whereby a first support for the axle element is formed and the latter is reliably centered. Then, the holding portion of the axle element is inserted into the undercut groove of the plate element whereby the connection is reinforced inasmuch as the cross-section of the holding portion of the axle element mates with the cross-section of the undercut groove of the plate element. Since the holding portion of the axle member is provided with the projecting connecting means, another structural element can be mounted on the plate element exactly at the same place where the axle element is inserted in the latter. This is especially important because in such a construction the force which is applied to the plate member by a vehicle structure is directly transmitted in the region of the axle element to the wheel of the structure.

Another feature of the present invention is that the connecting means of the holding portion of the axle element may include an undercut projection extending outwardly beyond one face of the plate element when the axle element is connected with the latter. It is also possible that two such undercut projections are formed on the holding portion of the axle element, each projecting outwardly beyond a respective one of the opposite faces of the plate element.

A further feature of the present invention is that the bore of the plate element may be open solely into the undercut groove thereof, it may form an extension of the undercut groove and may be coaxial with the latter. At the same time, the plate element may be provided with a plurality of such undercut grooves and bores.

A still further feature of the present invention is that the pin-shaped portion of the axle element may have a length which is at most equal to the length of the bore of the plate element, and both the pin-shaped portion and the bore may have a cylindrical cross-section. The holding portion of the axle element may have a length at most equal to the length of the undercut groove of the plate element, and both the holding portion and the undercut groove may have a polygonal cross-section.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a partially sectioned perspective view of an assembly kit in accordance with the present invention, showing a plate element and two axle elements, one of which axle elements are connected with the plate element whereas the other axle element is shown before the connection with the latter.

DESCRIPTION OF THE PREFERRED EMBODIMENT

As shown in the single FIGURE of the drawing, an assembly kit in accordance with the present invention includes a plate element 1 having two faces 1' and 1'' spaced from one another in one direction, and two side edges 2 and 3 spaced from one another in another direction.

The plate element 1 has at least one groove 4 which extends from one of the side edges 2 or 3 and is open at at least one of the faces 1' or 1''. As shown in the drawing, the groove 4 may be open simultaneously at two faces 1' and 1'' of the plate element 1. The groove 4 has an axis A and an undercut cross-section, preferably of a polygonal shape. A plurality of such grooves 4 may be formed in the plate element 1, as shown in the drawing.

The plate element 1 further has at least one bore 5 which communicates with the groove 4. A plurality of such bores 5 may be formed in the plate element 1 each communicating with a respective one of the grooves 4. The bore 5 may be formed as an extension of a respective groove 4 and may be open solely into said groove so that the bore 5 is located within a body of the plate element 1 and closed from all sides, excepting the side facing towards the groove 4. Each of the bores 5 may be coaxial with the respective groove 4 and may have a cylindrical cross-section.

The assembly kit in accordance with the present invention further includes an axle element which is identified in toto by reference numeral 6. The axle element 6 has a holding portion 7, a pin-shaped portion 8 and a shaft portion 9 connected with one another. The pin-shaped portion 8 of the axle element 6 may have a cylindrical cross-section corresponding to the cross-section of the bore 5 of the plate element 1. Preferably, the pin-shaped portion 8 of the axle element 6 has a length which is at most equal to the length of the bore 5 of the plate element 1.

The holding portion 7 of the axle element 6 is located between the pin-shaped portion 8 and the shaft portion 9. The holding portion 7 has an undercut cross-section preferably of a polygonal shape. The cross-section of the holding portion 7 of the axle element 6 mates with the cross-section of the groove 4 of the plate element 1. The holding portion 7 may have a length which is at most equal to the length of the groove 4.

The holding portion 7 is provided with projecting connecting means for connecting the same with another structural element of the assembly kit. As shown in the drawing, this connecting means may include at least one undercut projection 10 engageable with an undercut groove of the other structural element of the assembly kit. Since such A structural element is known per se in the art, it is not shown in the drawing for the sake of simplicity. The undercut projection 10 projects outwardly beyond the face 1' of the plate element 1. It is understood that two such undercut projections may be formed on the holding portion 7 of the axle element 6 so that each of the thus- formed projections projects outwardly beyond a respective one of the faces 1' or 1'' of the plate element 1.

The shaft portion 9 of the axle element 6 serves for mounting a wheel and the like thereon and may be of a cylindrical shape. The pin-shaped portion 8 of the holding element 6 has an axis B, and the holding portion 7 of the axle element 6, as well as the shaft portion 9 thereof, may be coaxial with the pin-shaped portion 8. The axle element 6 may be formed as an integral member.

The mounting of the elements of the assembly kit in accordance with the present invention is performed in the following way:

For connection of the axle element 6 with the plate element 1, the pin-shaped portion 8 of the axle element 6 is first inserted into the bore 5 so that a first support for the axle element 6 is formed and the latter is reliably centered. Then, the holding portion 7 of the axle element 6 enters the undercut groove 4 of the plate element 1, and the connection is reinforced since the cross-section of the holding portion mates with the cross-section of the undercut groove 4. When the axle element 6 is thus connected with the plate element 1, the undercut projection 10 of the holding portion 7 of the axle element 6 extends outwardly beyond the face 1' of the plate element 1 and can be connected with another structural element of the assembly kit. At the same time, the shaft portion 9 of the axle element 6 extends outwardly beyond the side edge 3 of the plate element 1 so that a wheel or the like can be mounted thereon.

It is understood that the other structural element of the assembly kit may be connected with the undercut projection 10 of the holding portion 7, and the wheel or the like may be mounted on the shaft portion 9 of the axle element 6 before the insertion of the axle element 6 into the groove 4 and the bore 5 of the plate element 1.

It will be understood that each of the elements described above, or two or more together, may also find a useful application in other types of constructions differing from the types described above.

While the invention has been illustrated and described as embodied in an assembly kit including a plate element and an axle element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an assembly kit, a combination comprising a plate element having two faces spaced from one another in one direction and two side edges spaced from one another in another direction, said plate element having an undercut groove extending from one of said side edges and open at at least one of said faces, and a bore communicating with said undercut groove; and an axle element having a pin-shaped portion insertable into said bore of said plate element, a holding portion connected with said pin-shaped portion and insertable into said groove of said plate element, said holding portion having a non-circular cross-section mating with the cross section of said groove and being provided with a projecting connecting means for connecting said holding portion with another structural element of the kit, and a shaft portion connected with said holding portion.

2. The combination as defined in claim 1, wherein said bore is open solely into said undercut groove.

3. The combination as defined in claim 2, wherein said undercut groove extends from said one side edge of said plate element in one direction, and said bore is an extension of said undercut groove in said one direction.

4. The combination as defined in claim 3, wherein said undercut groove has an axis, and said bore is coaxial with said undercut groove.

5. The combination as defined in claim 1, wherein said bore of said plate element and said pin-shaped portion of said axle element have a substantially cylindrical cross-section.

6. The combination as defined in claim 1, wherein the cross-section of said undercut groove of said plate element and the cross-section of said holding portion are polygonal.

7. The combination as defined in claim 1, wherein said holding portion of said axle element has a length which is at most equal to the length of said undercut groove of said plate element.

8. The combination as defined in claim 1, wherein said pin-shaped portion of said axle element has a length which is at most equal to the length of said bore of said plate element.

9. The combination as defined in claim 1, wherein said connecting means of said holding portion of said axle element include a connecting projection extending outwardly beyond said one face of said plate element, when said axle element is inserted into said plate element.

10. The combination as defined in claim 9, wherein said undercut groove is further open at the other face of said plate element, and said connecting means including a further connecting projection extending beyond said other face of said plate element, when said axle element is inserted in said plate element.

11. The combination as defined in claim 9, wherein said connecting projection of said holding portion has an undercut cross-section.

12. The combination as defined in claim 1, wherein said axle element is integral.

13. The combination as defined in claim 1, wherein said plate element further has at least one further such groove and such bore.

14. The combination as defined in claim 1, wherein said shaft portion of said axle element extends outwardly beyond said one side edge of said plate element, when said axle element is inserted in said plate element.

15. The combination as defined in claim 1, wherein said pin-shaped portion of said axle element has a further axis, said holding portion and said shaft portion of said axle element being coaxial with said pin-shaped portion.

16. In a toy assembly kit, a combination comprising a plate element having two faces spaced from one another in one direction and two side edges spaced from one another in another direction, said plate element having an undercut groove of a polygonal cross-section extending from one of said side edges and open at at least one of said faces, said plate element further having a cylindrical bore communicating with said undercut groove; and an axle element having a cylindrical pin-shaped portion insertable into said bore of said plate element, an undercut holding portion connected with said pin-shaped portion and insertable into said undercut groove of said plate element, said holding portion having a polygonal cross-section mating with the cross-section of said undercut groove and being provided with an undercut projection extending outwardly beyond said one face of said plate element and adapted to connect said holding portion with another structural element of the kit, and a shaft portion connected with said holding portion of said axle element.

* * * * *